United States Patent [19]

Appleman

[11] 4,047,582

[45] Sept. 13, 1977

[54] PORTABLE EARTH BORING MACHINE

[75] Inventor: William S. Appleman, Ashland, Ohio

[73] Assignee: The Richmond Manufacturing Company, Ashland, Ohio

[21] Appl. No.: 591,641

[22] Filed: June 30, 1975

Related U.S. Application Data

[63] Continuation-in-part of Ser. No. 455,254, March 27, 1974, abandoned.

[51] Int. Cl.[2] ..... E21D 9/02; E02D 7/28

[52] U.S. Cl. ..... 175/122; 173/43; 175/171

[58] Field of Search ..... 173/152, 154, 43; 175/122, 170, 171; 60/486; 408/130

[56] References Cited

U.S. PATENT DOCUMENTS

| | | | |
|---|---|---|---|
| 3,171,247 | 3/1965 | McAlvay | 60/486 X |
| 3,220,494 | 11/1965 | Cannon et al. | 173/152 |
| 3,464,502 | 9/1969 | Ageton | 173/152 |
| 3,587,755 | 6/1971 | Slusher | 175/122 X |
| 3,833,072 | 9/1974 | Back | 175/171 X |
| 3,869,003 | 3/1975 | Yamada et al. | 175/171 |
| 3,912,024 | 10/1975 | Richmond et al. | 175/171 X |

*Primary Examiner*—Ernest R. Purser
*Assistant Examiner*—William F. Pate, III

[57] ABSTRACT

A portable earth boring machine for the boring of vertically inclined shafts and the insertion of pipeline casing sections characterized by a main frame portion that supports the auger drive and casing pusher apparatus, and a detachably mounted engine frame portion that permits the transmission of power between the engine and the auger drive and casing pusher apparatus not only when the engine frame portion is positioned on the main frame portion at the boring location but also when said engine frame portion is detached and positioned at a location remote from the main frame means. The machine is further characterized by a novel control means for the casing pusher apparatus that provides for both relatively slow and relatively fast extension and retraction of the casing pusher so as to provide more efficient operation of the earth boring machine.

2 Claims, 5 Drawing Figures

FIG. 2-A.

PORTABLE EARTH BORING MACHINE

REFERENCE TO CO-PENDING APPLICATION

This application is a continuation-in-part of my co-pending application Ser. No. 455,254 filed Mar. 27, 1974 now abandoned.

BACKGROUND OF THE INVENTION

This invention relates to portable earth boring machines and more particularly to a machine adapted for the boring of vertically inclined shafts for the insertion of pipelines with said machine being adapted for remote control operation.

SUMMARY OF THE INVENTION

In general, the earth boring machine of the present invention comprises a base means that includes spaced track members which are vertically adjustable to various angles of inclination so as to adapt the boring machine for drilling holes and pushing casing sections into the earth at various selected angles of inclination. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

With machines of this general type problems have been encountered, in the function of advancing and retracting the above mentioned frame means along its track for the purpose of advancing and retracting the boring auger into various types of earth fill which may comprise anything from hard rock to soft earth. In addition, problems have been present in the pushing of the casing sections in that it is desirable to at some times advance the pusher ring and frame means at relatively fast speeds when the friction against the casing sections is low or when it is desired to rapidly retract the frame means along the carriage under low load conditions. Under such conditions prior machines of this type have been encumbered by pushing cylinder apparatus and associated control means which were incapable of both relatively slow and relatively rapid actuation.

In accordance with the present invention the earth boring machine is adapted for operation at various angles of inclination and provided with remote control apparatus for manipulation of the machine by an operator in a remote location.

As another aspect of the present invention the earth boring machine is provided with a novel hydraulic control means for the pushing cylinder apparatus which includes a novel volumetric fluid flow controller that can be set by the operator to either a "low flow" position, or a "high flow" position depending on the operational speed requirements during any particular portions of the boring or casing pushing operations.

As another aspect of the present invention, the control means is provided with a multiple pump source of pressurized fluid and associated control means which enable the operator selectively to deliver pressurized oil to the pushing cylinders either from one or both of the pumps.

As another aspect of the present invention, the novel control means is provided with a pressure compensated flow control means for establishing a predetermined volumetric flow to the pushing cylinders.

As still another aspect of the present invention the novel control means is provided with a maximum high pressure relief valve means which prevents the operator from at anytime overloading the components of the fluid circuit.

It is therefore a primary object of the present invention to provide a novel earth boring machine adapted for operation at various angles of inclination so as to permit the boring of vertically extending shafts as well as the pushing of casing sections into said shafts.

It is another object of the present invention to provide an earth boring machine with a novel control system that includes both a low volumetric flow stage and a high volumetric flow stage for the selective operation of the pushing cylinders at either relatively slow or relatively fast speeds.

It is another object of the present invention to provide a boring machine with a control system of the type described that is operated by two relatively small and inexpensive pumps yet which has the capacity for relatively rapid actuation of the pushing cylinders.

It is still another object of the present invention to provide a boring machine with a control system of the type described which includes safety means for preventing the operator from anytime overloading the hydraulic system.

Further objects and advantages of the present invention will be apparent from the following description, reference being had to the accompanying drawings wherein preferred forms of embodiments of the invention are clearly shown.

BRIEF DESCRIPTION OF THE DRAWINGS

FIG. 2-A is a perspective view of a control station for the machine of the present invention;

DESCRIPTION OF THE PREFERRED EMBODIMENT

Figure 1:
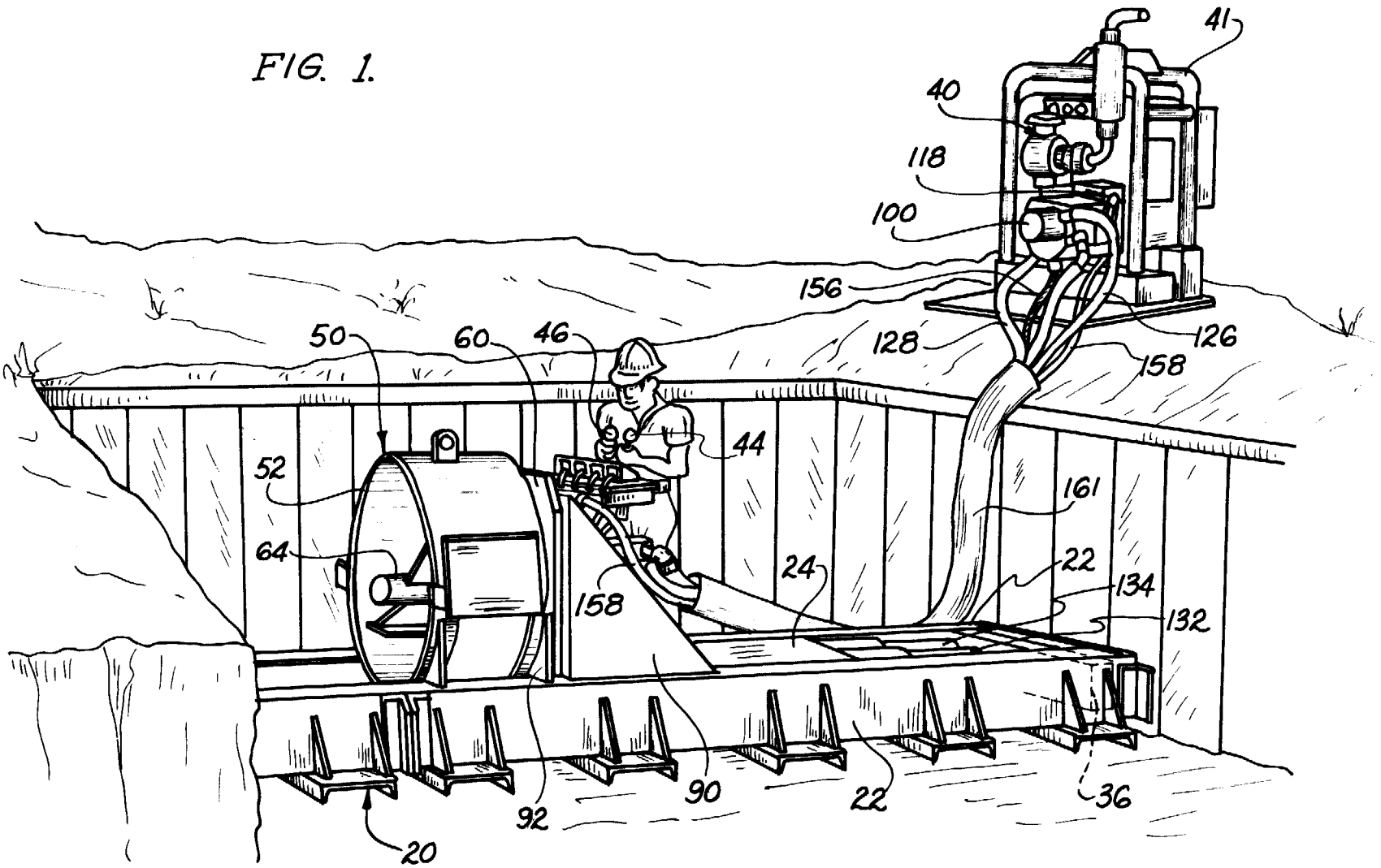
FIG. 1 is a perspective view of a boring machine constructed in accordance with the present invention and showing the main frame portion of such machine disposed in a trench in a boring position with the removable engine frame portion positioned outside the trench.
Figure 2:
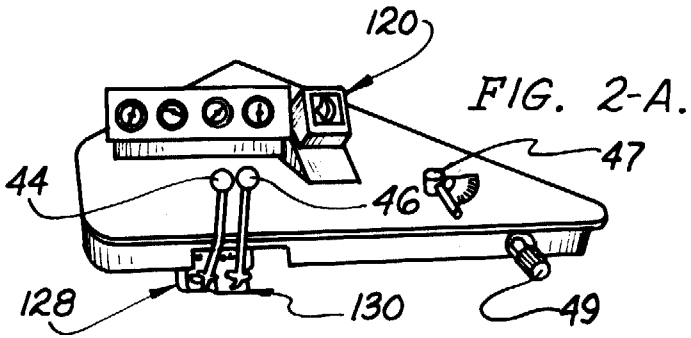
FIG. 2 is a side elevational view of the boring machine of FIG. 1.
Figure 2:
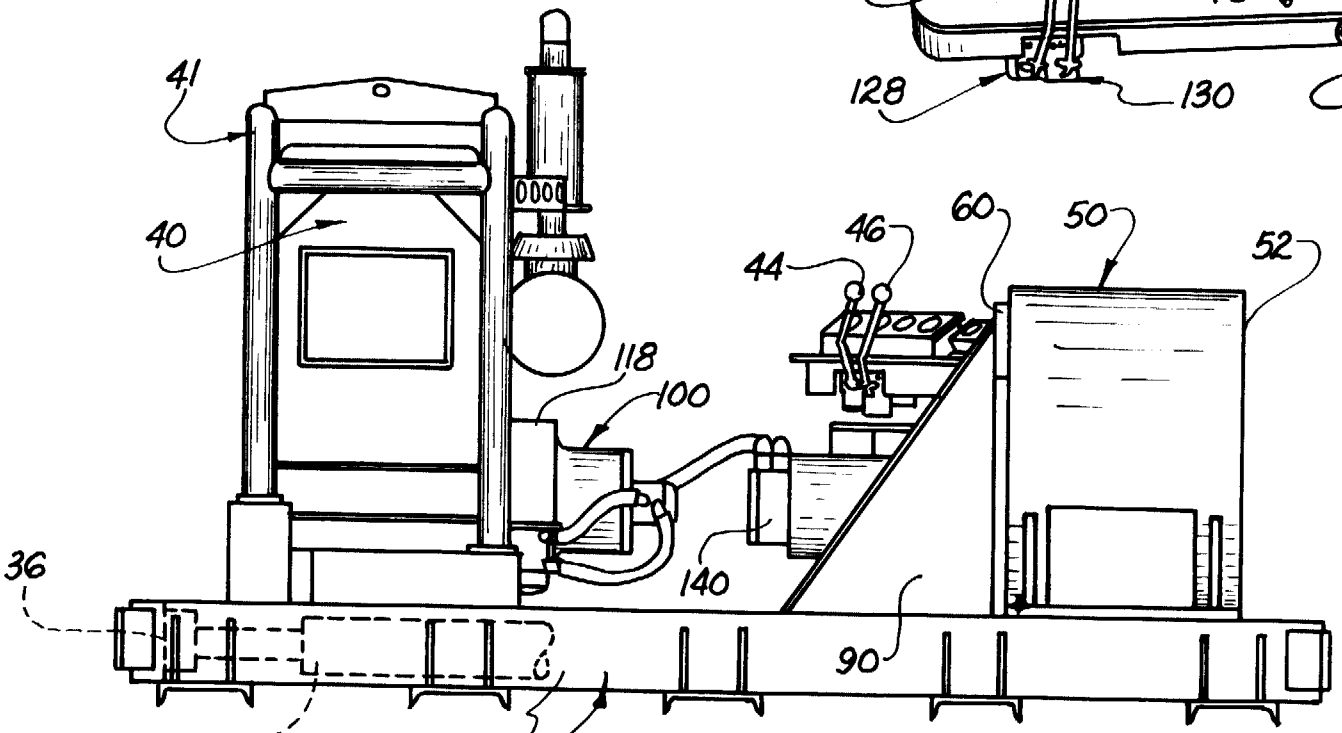

Referring in detail to the drawings, FIGS. 1 and 2 illustrate the complete horizontal earth boring machine of the present invention which comprises a base means indicated generally at 20. Such base means includes spaced longitudinally extending track means 22 which support a carriage means indicated generally at 24.

The carriage means 24 is advanced and retracted along track 22 by hydraulic power cylinders, a portion of which is seen at 134 in FIG. 1. With such power cylinder being operatively connected between a power cylinder base 36 and the carriage means 24.

Details of typical power cylinders such as 132 and 134 and power cylinder base 36 are disclosed and described in detail in the application of Albert R. Richmond, Ser. No. 867,816 filed Oct. 20, 1969, now U.S. Pat. No. 3,612,195 issued Nov. 12, 1971.

Figure 3:
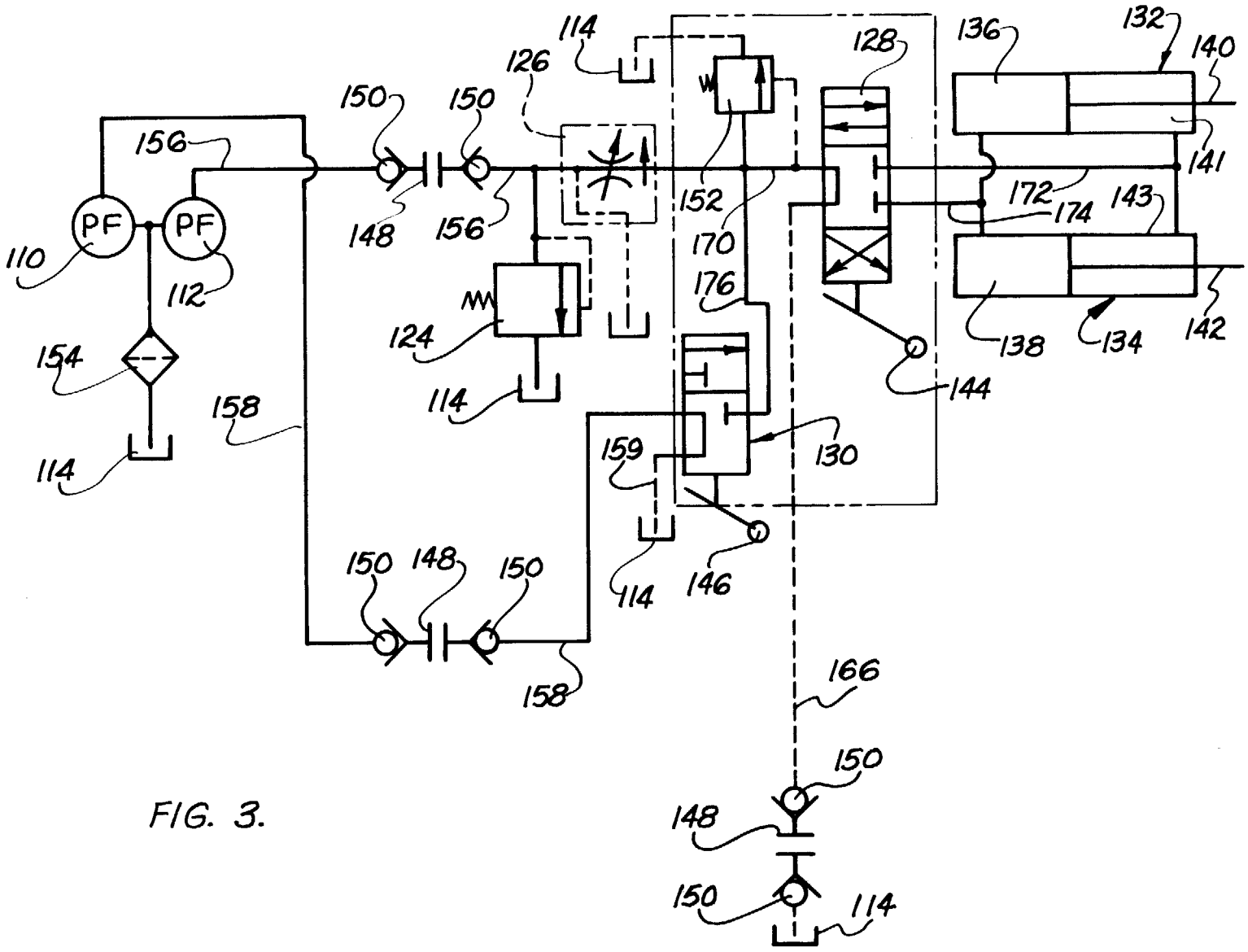
FIG. 3 is a diagrammatic view of a hydraulic circuit comprising the control means for the machine of the present invention.

It will be further seen that pressurized fluid for actuating power cylinders 132 and 134 is provided by a fluid power system, FIG. 3, including pumps 110 and 112 driven by an engine 40. The fluid power circuit further includes a control valve mechanisms 144 and 146 and conduits 172 and 174 such that when control valve mechanisms are actuated the pushing cylinders 134-132 are extended or retracted so as to move carriage 24 forwardly or rearwardly along the track means 22.

Referring again to FIG. 1, the boring machine further includes a pusher ring 50 including a front annular surface 52 for engaging the sections of pipe casing for pushing such sections into the bored hole. Such pusher ring 50 includes a thrust plate 60 mounted on the carriage means with such thrust plate 51 serving as a mount for a thrust bearing, not illustrated, for the auger connecting shaft 64. The mechanism comprising the thrust plate 60, the thrust bearing assembly mounted thereon, and the back-up plates 90 transmit the thrust from the auger connecting shaft 64 to the carriage means 24 and thereby isolate the power train from the thrust.

A typical auger construction for connection with the machine of the present invention is disclosed and described in detail in the application of Albert R. Richmond, Ser. No. 85,614 filed Oct. 30, 1970, now U.S. Pat. No. 3,693,734 issued Sept. 26, 1972.

Reference is next made to the diagram of the hydraulic circuit for the pushing cylinders, FIG. 3, which includes pump means comprising two fixed displacement pumps 110 and 112. Fluid from pump 112 flows through line 156 and quick disconnect coupling 150 to a pressure compensated flow control valve 126. Such flow control valve 126 functions to establish a predetermined volumetric flow of pressurized fluid from pump 112 to a pushing cylinder means comprising two pushing cylinders 132 and 134.

Immediately upstream of flow control valve 126 is an adjustable pressure relief valve 124 for releasing excess pressurized fluid back to tank 114. Fluid leaving the pressure compensated flow control valve 126 passes via line 170 to a four-way valve 128 which is used to directionally control the pushing cylinders indicated generally at 132 and 134. This four-way valve is manipulated by a control lever 144 such that when lever 144 is in an "extension" position fluid from the valve is delivered to the base chambers 136 and 138 of the cylinders via line 174 and drained from the rod chambers 141 and 143. The rods 140 and 142 are thereby extended creating the pushing pressures. When it is desired to retract the rod ends 140 and 142 of pushing cylinders 132 and 134 then four-way valve actuating lever 144 is shifted to a "retract" position and pressurized fluid is thereby delivered via lines 170 and 172 to the rod chambers 141 and 143 of the pushing cylinders 132 and 134 and fluid is drained from base chambers 136 and 138 via lines 174 and 166 to tank 114.

The previously mentioned adjustable pressure relief valve 124 is provided in line 156 in order to selectively control the desired pressures for the particular type of earth being drilled. For example, in the drilling of solid granite which is encountered in New England and similar terrain it is necessary to prevent the application of excessive pressures otherwise the boring head or drill can easily be damaged. At other times with softer terrain it is desired to have higher pressures. Moreover, during casing pushing operations the string of casing sections increases in length more and more pressure is required to move the lengthened string against earth imposed friction without exceding the permissable force on the forward casing section.

Reference is next made to the function of the other fixed displacement pump 110 in FIG. 3 where it will be seen that the pressurized fluid is delivered via conduit 158 and quick disconnect coupling 148 to a volumetric flow varying controller in the form of a valve 130 which is provided with a manual actuator or control lever 146.

In normal boring operations valve 130 is left in a neutral position wherein fluid from pump 110 circulates continuously back to tank 114 via line 158, valve 130 and line 159 back to tank 114.

Under certain boring conditions or under fast retract operation of the pushing cylinders 132 and 134 there is a demand for a high volumetric flow of oil and the second pump 110 is connected into the load circuit and the fluid therefrom is delivered to the pushing cylinders by action of valve 130 to connect the previously mentioned line 158 to the inlet of directional control valve 128 via lines 176 and 170, with valve 130 being closed to tank return line 159.

It will be seen from FIG. 3 in such high volumetric flow conditions the total flow of oil from both the pumps is still controlled by the directional control valve 128 in the manner previously described.

Referring again to FIG. 3 it will be noted that a preset maximum pressure relief valve 152 is connected ahead of the four-way valve 128 at line 170 and functions to limit the maximum fluid pressure which can at any time be imposed on the system.

It should be mentioned that the lines 156, 158, and 166 are preferably provided with quick disconnect couplings 148-150 such that the remote control loom 161 of flexible conduits and wires can be readily installed for the remote control operating position of FIG. 1. When the removable engine frame portion 41 is positioned on the main frame means, as seen in FIG. 2, the fluid conduit and wire connections are short and the remote control loom 161 is not needed.

Figure 4:
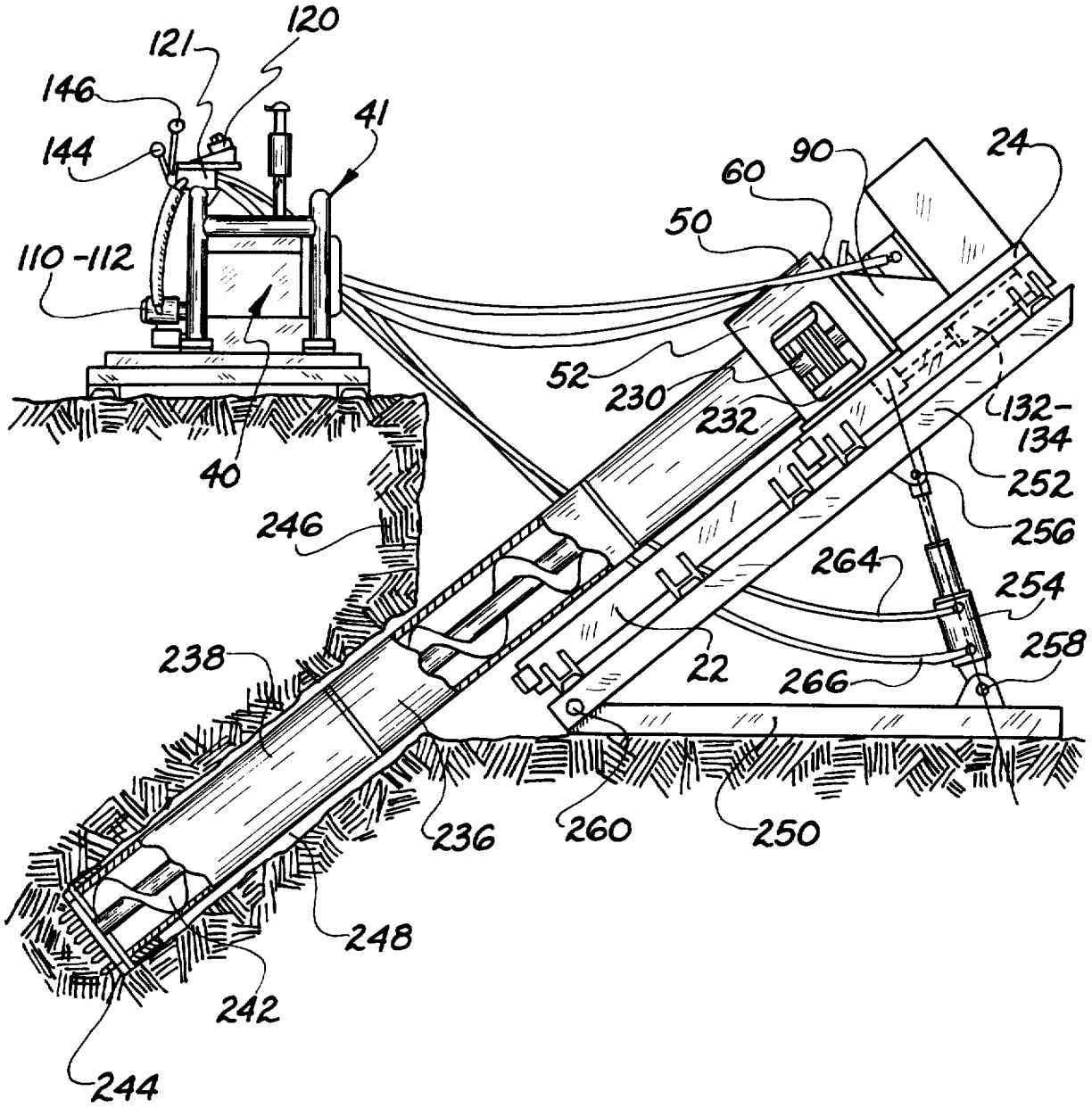
FIG. 4 is a side elevational view, partially in section, of a modified boring machine constructed in accordance with the present invention and adapted for vertically inclined boring operations.

Reference is next made to FIG. 4 which illustrates a modified boring machine constructed in accordance with the present invention, such machine being adapted for the boring of vertically inclined holes such as the holes 248, FIG. 4.

With continued reference to FIG. 4, the vertical boring apparatus comprises inclined track supporting frame members 252 which are pivotally mounted on a base 250 at the pivot 260. The angle of inclination of vertically inclined frame members 252 is selectively varied by the extension or retraction of a telescoping power cylinder 254. This cylinder has its base end mounted to base means 250 at a pivot 258 and its rod end mounted to inclined frame members 252 at pivot 236. Telescoping power cylinder 254 is connected to a source of pressurized fluid and reservoir via lines 266 and 264 respectively. Hence it will be understood that the extension and retraction of telescoping cylinder 254 is remotely controlled by a conventional control valve, not illustrated, which may be positioned at auxiliary frame means 41 or at any other remote location.

With continued reference to FIG. 4, the previously mentioned spaced track members 22, FIG. 1, are mounted on the vertically extending frame members 252 and the casing pusher ring 50 is advanced and retracted by the pushing cylinders 132–134 for the purpose of pushing the casing sections such as 236 and 238 into the bored hole.

With continued reference to FIG. 4, this view further illustrates earth boring auger sections 242 which are added as the boring progresses as well as a front cutting head 244.

The operation of the vertical embodiment of FIG. 4 is similar to the embodiment previously described wherein the manual actuators 144 and 146 are actuated by the operator for the purpose of operating the previously described valves 128 and 130 which extend and retract pushing cylinders 132 and 134 whereby the casing pusher ring and thrust plate 160 are advanced and retracted so as to permit the insertion of successive casing sections 236 and 238 as the boring of the hole progressses.

It should be mentioned that boring auger 242 is driven by a fluid motor 100 which is in turn driven by a variable volume pump 140. Such variable speed auger driving apparatus is described in detail in my co-pending application Ser. No. 455,388 filed Mar. 27, 1974.

It should be further mentioned that the variable speed drive for the auger 242 is remotely controlled by an electric controller 120 which can be removed from the console 121 and carried around by the operator. The details of such electrical remote control device 120 is set forth in the above mentioned co-pending application.

Referring again to FIG. 4, the casing pusher ring 50 is provided with an earth discharge opening 230 with the drillings from the auger 242 being continuously discharged from such opening by the rotating blades 232 mounted on the auger connecting shaft means 64.

While the forms of embodiments of the present invention as herein disclosed constitute preferred forms, it is to be understood that other forms might be adopted.

What is claimed is:

1. An earth boring apparatus for drilling vertically extending holes and pushing casing sections therein, said apparatus comprising, in combination, vertically extending track means; casing pusher means on said track means for engaging the rear end of a casing section; pushing cylinder means for moving said casing pusher means along said track means and including an extension chamber and a retraction chamber; auxiliary frame means for disposition at a location remote from said main frame means; an engine mounted on said auxiliary frame means; pump means driven by said engine for delivering pressurized fluid to said pushing cylinder means; conduit means connecting said pushing cylinder means with said pump means; control means including a directional valve means in the flow of pressurized fluid from said pump means to said pushing cylinder means, said directional valve means including a closed center position for isolating both of said chambers from said flow, an extension position for pressurizing said extension chamber and draining said retraction chamber, and a retract position for pressurizing said retraction chamber and draining said extension chamber; volumetric flow varying controller in said control means and including a low flow position for delivering a relatively low volumetric flow from said pump means to said pushing cylinder means and a high flow position for delivering a relatively high volumetric flow from said pump means to said pushing cylinder means; a first manual actuator for said control means for selectively positioning said directional valve means in said center, extension, and retraction positions; a second manual actuator for said control means for selectively positioning said volumetric flow varying valve means in said low flow and high flow positions; and variable flow control means in the flow of pressurized fluid from said pump means to said directional controller , said pump means including a first pump for delivering a first flow of pressurized fluid to said directional valve means, and a second pump for delivering a second flow of pressurized fluid to said volumetric flow varying controller.

2. An earth boring apparatus for drilling vertically extending holes and pushing casing sections therein, said apparatus comprising, in combination, vertically extending track means; casing pusher means on said track means for engaging the rear end of a casing section; pushing cylinder means for moving said casing pusher means along said track means and including an extension chamber and a retraction chamber; auxiliary frame means for disposition at a location remote from said main frame means; an engine mounted on said auxiliary frame means; pump means driven by said engine for delivering pressurized fluid to said pushing cylinder means; conduit means connecting said pushing cylinder means with said pump means; control means including a directional valve means in the flow of pressurized fluid from said pump means to said pushing cylinder means, said directional valve means including a closed center position for isolating both of said chambers from said flow, an extension position for pressurizing said extension chamber and draining said retraction chamber, and a retract position for pressurizing said retraction chamber and draining said extension chamber; volumetric flow varying controller in said control means and including a low flow position for delivering a relatively low volumetric flow from said pump means to said pushing cylinder means and a high flow position for delivering a relatively high volumetric flow from said pump means to said pushing cylinder means; a first manual actuator for said control means for selectively positioning said directional valve means in said center, extension, and retraction positions; a second manual actuator for said control means for selectively positioning said volumetric flow varying valve means in said low flow and high flow positions; and variable flow control means in the flow of pressurized fluid from said pump means to said directional controller, said control means including a maximum pressure relief valve means in the flow of pressurized fluid to said pushing cylinder means.

* * * * *